United States Patent [19]

Penland et al.

[11] 4,388,503

[45] Jun. 14, 1983

[54] MULTIPLE POSITION PUSHBUTTON SWITCH

[75] Inventors: William D. Penland, Weaverville; Harold F. Loew, Asheville, both of N.C.

[73] Assignee: Square D Company, Palatine, Ill.

[21] Appl. No.: 292,776

[22] Filed: Aug. 14, 1981

[51] Int. Cl.[3] ..... H01H 13/70

[52] U.S. Cl. ..... 200/5 R; 200/159 A

[58] Field of Search ..... 200/1 A, 1 R, 1 TK, 200/5 R, 5 B, 6 B, 6 BA, 6 BB, 16 R, 16 B, 16 E, 153 L, 153 LA, 159 R, 159 A, 160, 283, 314, 340, 1 B

[56] References Cited

U.S. PATENT DOCUMENTS

| | | | |
|---|---|---|---|
| 3,835,276 | 9/1974 | Field | 200/160 |
| 4,130,744 | 12/1978 | Beecher et al. | 200/159 A X |
| 4,317,968 | 3/1982 | Kuhfus | 200/5 R |
| 4,339,643 | 7/1982 | Murmann | 200/6 BB |

*Primary Examiner*—J. R. Scott

*Attorney, Agent, or Firm*—Michael J. Femal; William H. Schmeling

[57] ABSTRACT

This disclosure depicts a novel multiple position electric pushbutton switch. The novel switch comprises a cam and a movable contact assembly having at least two spring elements, each having an electrical contact and a cam-engaging portion. The switch further comprises at least two stationary electrical contacts for contacting the electrical contacts of the movable contact assembly. A housing is provided for containing the cam, the movable contact assembly and the stationary contacts. As the cam is depressed and moved downward into the housing, the cam engages one of the spring elements of the movable contact assembly causing the electrical contact on the spring element to contact a corresponding stationary electrical contact. As the cam is depressed further into the housing, the cam engages a second spring element causing the electrical contact on the second spring element to contact a corresponding stationary contact thereby resulting in a sequential connection of the electrical contacts as the cam is depressed into the housing.

13 Claims, 7 Drawing Figures

MULTIPLE POSITION PUSHBUTTON SWITCH

CROSS-REFERENCE OF RELATED APPLICATIONS

This application relates to, but is in no way dependent upon, co-pending application of common ownership, Ser. No. 293,039, filed Aug. 14, 1981.

BACKGROUND OF THE INVENTION

This invention relates, in general, to electric pushbutton switches and, in particular, to a pushbutton switch having multiple positions. The novel pushbutton switch engages additional electrical contacts as it is depressed to a greater depth.

Numerous types of electric pushbutton switches can be found in the prior art. Most of these switches are of the type that, when the pushbutton is depressed, one or more electrical contacts close simultaneously. Of those types which have multiple positions, a general design results in the following operation; the pushbutton first contacts a spring portion of the movable contact and then, as the pushbutton is depressed further, another electrical contact is engaged, the spring portion of the first contact engaged must be bent to a greater extent. Many disadvantages result from this design, including excessive fatigue of the spring components.

The present invention overcomes a number of problems and disadvantages in the prior art and provides a multiple position pushbutton in which the electrical contacts close at a predetermined depth of the pushbutton and, once closed, are not subjected to any further forces.

The present invention has general applicability but is most advantageously applied to a pair of electric pushbutton switches as is also disclosed in the referenced co-pending application.

OBJECTS OF THE INVENTION

It is a general object of the present invention to provide an improved multiple position electric pushbutton switch.

It is a more specific object of the present invention to provide a multiple position pushbutton switch utilizing a straight line action.

It is another object of the present invention to provide a multiple position pushbutton switch having a minimum number of moving parts which is easy to manufacture.

It is a further object of the present invention to provide a multiple position pushbutton switch which is easily adapted for any number of electrical contacts.

It is still a further object of the present invention to provide a multiple position pushbutton switch with a detent action so that the operator can feel each position.

BRIEF DESCRIPTION OF THE DRAWINGS

The features of the present invention which are believed to be novel are set forth with particularity in the appended claims. The invention, together with further objects and advantages, may best be understood by reference to the following description taken in conjunction with the accompanying drawings, in the several figures of which like reference numerals indentify like elements, and in which:

DESCRIPTION OF THE PREFERRED EMBODIMENT

This invention relates to a novel multiple position electric pushbutton switch. The novel switch may incorporate any number of electrical contacts and terminals. Typically, one terminal will be a common terminal and the rest of the terminals will complete electrical circuits with the common terminal in sequence as the pushbutton is depressed. That is, the greater the distance the pushbutton is depressed, the more electrical terminals will be connected to the common terminal.

The present invention will now be described. In general terms, the novel multiple position electric pushbutton switch comprises a cam and a movable contact assembly having at least two spring elements, each of the spring elements having an electrical contact and a cam-engaging portion. The pushbutton switch further comprises at least two stationary electrical contacts for contacting the electrical contacts of the movable contact assembly. A housing is provided for containing the cam, the movable contact assembly and the stationary contacts.

As the cam is depressed and moved downward into the housing, the cam engages one of the spring elements of the movable contact assembly causing the electrical contact on the spring element to contact a corresponding stationary electrical contact. As the cam is depressed further into the housing, the cam engages a second spring element causing the electrical contact of the second spring element to contact the corresponding stationary electrical contact thereby resulting in a sequential connection of the electrical contacts as the cam is depressed into the housing.

Figure 1:
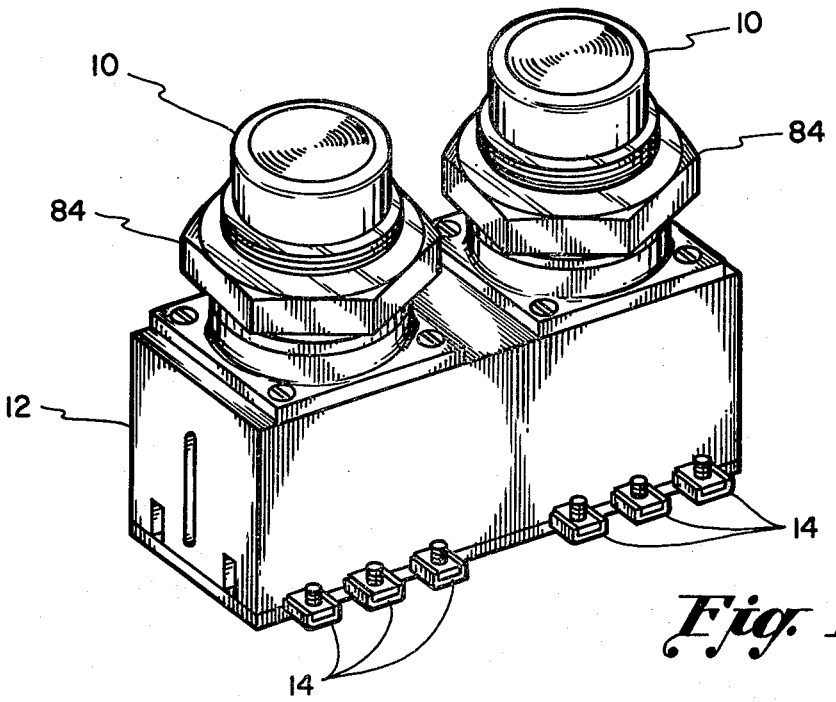
FIG. 1 is a perspective view of the novel multiple position pushbutton switch.

FIG. 1 shows a pair of multiple position electric pushbutton switches embodying the present invention. Each of the pushbutton switches 10 is contained in a housing 12 which has electrical terminals 14 available for connection to wires leading to electrical equipment. It is understood that the housing 12 could be constructed to contain only one pushbutton 10 or three or more pushbuttons.

Figure 3:
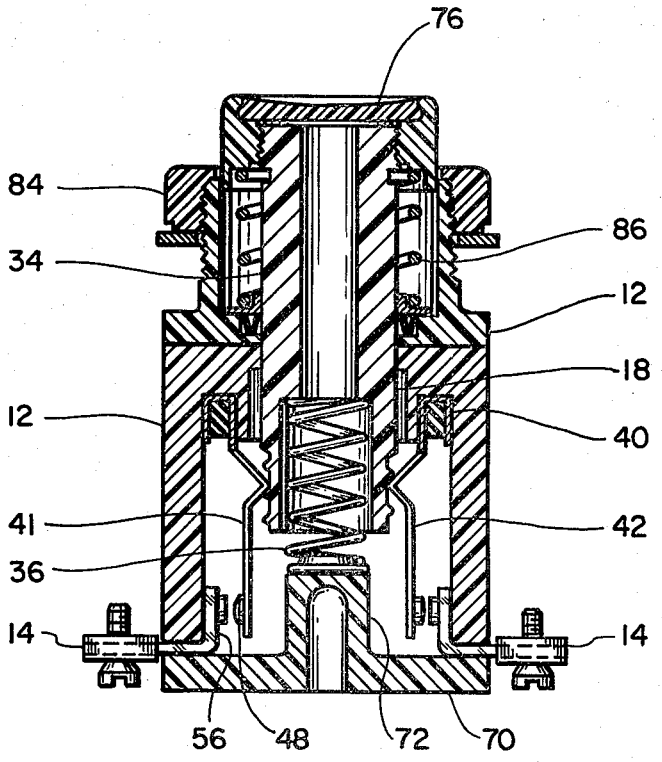
FIG. 3 is a cut-away side view of the novel switch.
Figure 2:
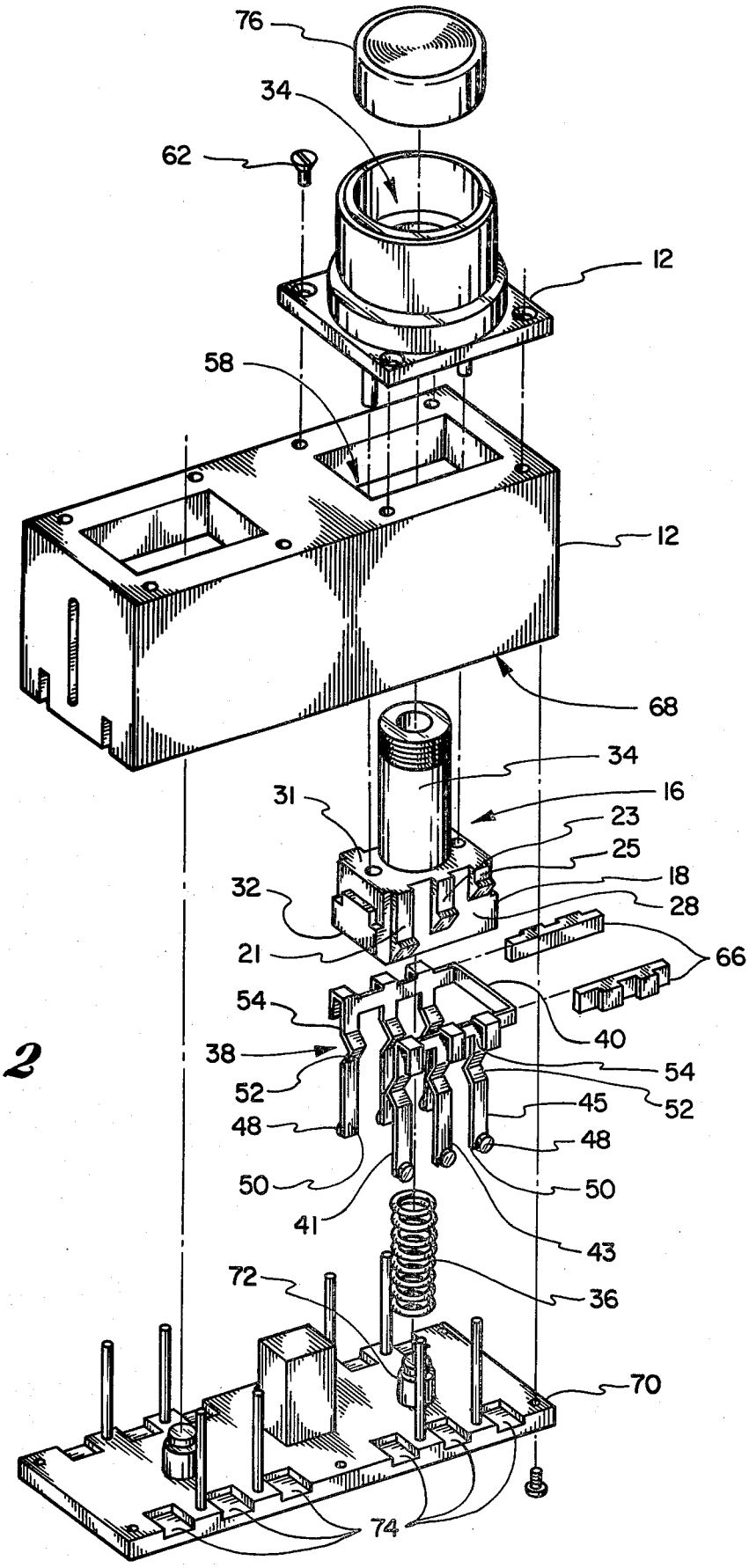
FIG. 2 is an exploded perspective view of the novel multiple position electric switch.
Figure 5:
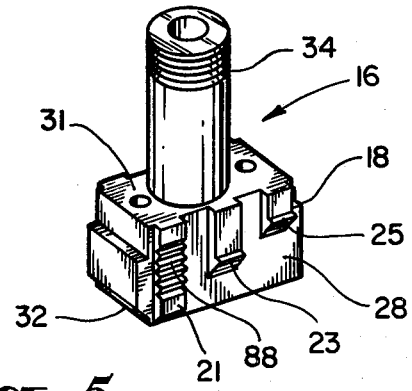
FIGS. 5 and 6 are side views of a cam used in the novel switch.
Figure 6:
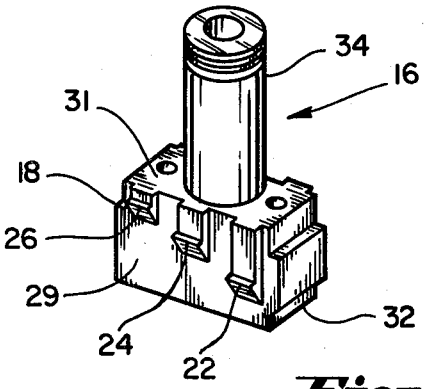

FIG. 2 shows an exploded perspective view detailing one of the pushbutton switches 10 and FIG. 3 shows a cross-sectional cut-away view of one of the pushbutton switches 10. The novel pushbutton switch 10 first comprises a cam 16. The cam 16 has a substantially rectangular body 18 with three raised portions 21, 23 and 25 on a first side 28 of the body 18 and three raised portions 22, 24 and 26 on a second side 29 of the body 18. FIGS. 5 and 6 are perspective views of the cam 16 showing both sides 28 and 29 of the cam 16. The body 18 has a predetermined length and the first raised portion 21 extends substantially the entire length of the body 18. Each of the other raised portions 22, 23, 24, 25 and 26 extends from a first end 31 and terminates a predetermined distance from a second end 32 of the body 18.

A stem 34 is attached to the first end 31 of the body 18 of the cam 16 and extends a predetermined distance. A return spring 36 is attached to the second end 32 of the body 18 of the cam 16.

Figure 4:
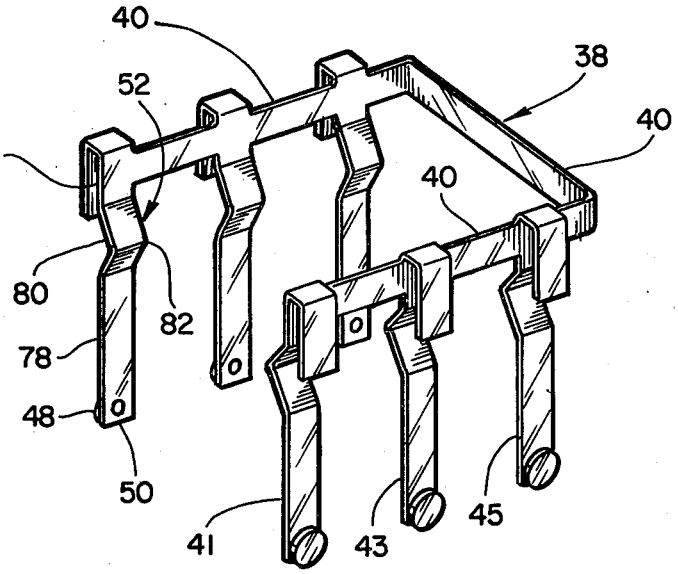
FIG. 4 is a perspective view of a movable contact assembly utilized in the switch.

A movable contact assembly 38 has a substantially U-shaped support section 40 which surrounds the rectangular body 18 of the cam 16. Three spring elements 41, 43 and 45 extend from one side of the support section 40 and three spring elements 42, 44 and 46 extend from the other side of the support section 40. Each of the spring elements 41, 42, 43, 44, 45 and 46 has an electrical contact 48 on a first end 50 and a cam-engaging portion 52 near a second end 54. These spring elements are connected to the support section 40 at their second end 54 and are in alignment with the raised portions 21, 22, 23, 24, 25 and 26 on the body 18 of the cam 16. FIG. 4 shows a perspective view of the movable contact assembly 38.

Figure 7:
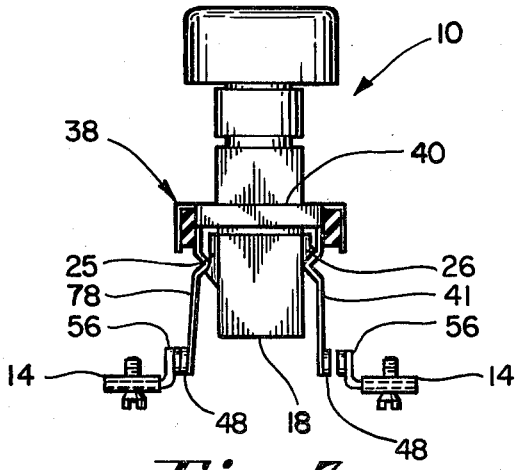
FIG. 7 is a schematic drawing illustrating how the cam operates the movable contact assembly in the multiple position pushbutton switch.

Six stationary electrical contacts 56 for contacting the electrical contacts 41, 42, 43, 44, 45 and 46 of the movable contact assembly 38 are provided and two of which are shown in FIG. 7.

The housing 12 is provided for containing the cam 16 and has a rectangular chamber 58 in which the body 18 of the cam 16 moves. An opening for the stem 34 is provided in the housing 12. FIG. 2 shows the housing 12 comprising two separate parts which are attached together with screws 62. However, it is possible to mold the housing 12 as one piece. The housing 12 also has a retaining wall 64, shown in FIG. 3, about the rectangular chamber 58 for holding the movable contact assembly 38 in position. Blocks 66 are utilized to secure the movable contact assembly 38 to the housing 12 and retaining walls 64. Numerous other structures could be utilized to attach the movable contact assembly 38 to the housing 12. The housing 12 also has an open bottom 68 opposite the rectangular chamber 58.

A cover 70 is attached to the open bottom 68 of the housng 12 and supports the six stationary electrical contacts 56 and also provides an attachment post 72 for the return spring 36. The six stationary electrical contacts 56 are held in position by recesses 74 in the cover 70.

Decorative cap 76 is attached to the end of the step 34 in the assembled pushbutton switch 10.

Referring now to FIGS. 5 and 6 in the preferred embodiment, the second, third, fourth, fifth and sixth of the raised portions 22, 23, 24, 25 and 26 extend respectively approximately 1/6, 2/6, 3/6, 4/6 and 5/6 of the predetermined length of the body 18 of the cam 16 from the first end 31 of the body 18. In operation, when the pushbutton is depressed, the first raised portion 21 almost immediately contacts the first spring element 41 and the corresponding terminal is referred to as the common terminal. As the pushbutton is depressed further, the second raised portion 22 will contact the second spring element 42, establishing an electrical path between the common terminal and the stationary terminal corresponding to the second spring element 42. As the cam 16 is depressed further, the remaining raised portions and spring elements will engage sequentially establishing more electrical paths. The movable contact assembly 38 as shown in FIG. 4 is formed of an electrically conductive metal. The first, third and fifth raised portions 21, 23 and 25 are located on the first side 28 of the body 18. The second, fourth and sixth raised portions 22, 24 and 26 are located on the second side 29 of the body 18 of the cam 16.

As shown in FIG. 4, each of the spring elements 41, 42, 43, 44, 45 and 46 is provided by a flexible blade 78 of predetermined length extending between the first end 50 of the spring element and the cam-engaging portion 52. The cam-engaging portion 52 has an apex right 80 with a tip 82 engageable with the raised portions of the body 18 of the cam 16. The apex 80 is flexibly connected to the second end 54 of the spring element.

FIG. 7 schematically illustrates the operation of the novel pushbutton switch 10. In this figure, the pushbutton switch 10 has been partially depressed with the first raised portion 25 engaging the first spring element 41 thereby causing the electrical contact 48 on the first spring element 41 to contact one of the stationary electrical contacts 56. The second raised portion 26 has not yet engaged the second spring element 42 and therefore no electrical connection has been made between the electrical contact 48 on the second spring element 42 and the corresponding stationary electrical contact 56. As the pushbutton 10 is depressed further, this engagement will take place creating an electrical path between the two stationary electrical contacts shown in the FIG. 7 diagram.

FIG. 3 is a cross-sectional view of the novel pushbutton switch 10 in an assembled form. A large nut 84 is provided for securing the pushbutton switch 10 to a case (not shown). FIG. 3 shows an additional return spring 86 in the upper portion of the pushbutton switch 10.

Various combinations of the raised portions on the body of the cam and the cam-engaging portions on the spring element are possible. In the preferred embodiment the raised portions are of such a length and orientation that the electrical contacts are engaged in a linear sequential fashion. By altering the lengths of the raised portions the engagement of the electrical contact could take place in other manners, such as in sequential logarithmic fashion. If desirable, two or more contacts could engage simultaneously or in any other combination. Also, pushbutton switches having only two sets of electrical contacts could be constructed, or with more than six sets of electrical contacts. Theoretically, any number of electrical contacts could be constructed with the pushbutton switch.

In FIG. 5 the first raised portion 21 on the body 18 of the cam 16 is shown as a series of notches 88. The purpose of the notches 88 is that when they are engaged by the cam-engaging portion 52 of the first spring element 41, the operator will feel the engagement of the notches and the other raised portions and spring elements thereby giving the operator a feel for how far the pushbutton has been depressed.

The invention is not limited to the particular details of the apparatus depicted and other modifications and applications are contemplated. Certain other changes may be made in the above-described method without departing from the true spirit and scope of the invention herein involved. It is intended, therefore, that the subject matter in the above depiction shall be interpreted as illustrative and not in a limiting sense.

What is claimed is:

1. A multiple position electric pushbutton switch comprising;

a movable cam, a movable contact assembly having at least two electrically and physically interconnected spring elements with each element having an electric contact portion and a cam engaging portion, at least two stationary contacts with each stationary contact engagable with one of the contact portions, a housing containing the cam, the movable contact assembly and the stationary contacts and at least two cam surfaces on the cam with each cam surface engagable with one of the cam engaging portions, said cam surfaces having a location on the cam so a first of said surfaces engages a cam portion on a first of the spring elements upon movement of the cam to a first position in the housing and a second of the cam surfaces engages a cam portion on a second of the spring elements upon movement of the cam from the first position to a second position in the housing.

2. The pushbutton switch as recited in claim 1 wherein the cam has a rectangular shaped body and the movable contact assembly has a U-shaped support section surrounding three sides of the cam body, with each of the spring elements extending from the support section to a free end with an electrical contact at the free end and the cam portions located intermediate the support section and the free end.

3. The apparatus described in claim 1 wherein said cam has a substantially rectangular body with three raised portions on a first side of said body and three raised portions on a second side of said body, said body having a predetermined length and a first of said raised portions extending substantially the entire length of said body, said other raised portions being of different lengths and extending from a first end of said body and terminating a predetermined distance from a second end of said body.

4. The apparatus described in claim 2 wherein said cam has a substantially rectangular body with three raised portions on a first side of said body and three raised portions on a second side of said body, said body having a predetermined length and a first of said raised portions extending substantially the entire length of said body, said other raised portions being of different lengths and extending from a first end of said body and terminating a predetermined distance from a second end of said body.

5. The apparatus described in claim 3 wherein a second, third, fourth, fifth and sixth of said raised portions extend respectively approximately 1/6, 2/6, 3/6, 4/6 and 5/6 of said predetermined length of the body of the cam from the first end of said body.

6. The pushbutton switches as recited in claim 1 wherein each of the spring elements is provided by a flexible metal portion of predetermined length that extends from a free end including the contact portion to a portion interconnecting the spring elements and the cam engaging portion is located between the free end and the interconnecting portion.

7. A multiposition electric pushbutton switch comprising:

a cam having a body portion with a stem extending from a first end of the body portion, a movable contact assembly including a unitary member providing at least two electrically and physically interconnected spring elements with each element having an electric contact portion at a first end of the element and a cam engaging portion providing an apex spaced from the first end;

a housing containing the cam, the movable contact assembly and providing an opening for the stem, at least two stationary contacts with each of the stationary contacts positioned by the housing to engage one of the contact portions, a spring positioned at a second end of the cam biasing the cam to a first position in the housing, and at least two cam surfaces on the cam with each cam surface engagable with one of the apexes on the spring elements said cam surfaces having a location on the cam so a first of said cam surfaces engages a first of said apexes and causes an engagement between a first of the contact portions and a first of the stationary contacts when the stem and cam are moved to a first position in the housing and a second of said cam surfaces engages a second of said apexes and causes an engagement between a second of the contact portions and a second of the stationary contacts when the stem and cam are moved from the first position to a second position in the housing thereby providing a sequential connection of the electrical contacts as the stem and cam are depressed in said housing.

8. The apparatus described in claim 7 wherein the body of the cam is substantially rectangular in shape and has a predetermined length with at least one cam surface on a first external side of said body and a second cam surface on the body on an external side opposite the first side, the cam surface portion on the first side extending substantially the entire length of the body and the second cam surface extending a predetermined distance less than the length of the body.

9. The apparatus described in claim 7 wherein the support section of the movable contact assembly is substantially U-shaped and surrounds the body of the cam and wherein the spring elements are attached to the support section in alignment with the cam surfaces on the body of the cam, the cam engaging portions of the spring elements being spaced equally from the first end of said spring elements such that the cam surfaces sequentially engage the cam engaging portions of the spring elements.

10. A multiple position electric pushbutton switch comprising:

a cam having a substantially rectangular body with three raised portions on a first side of said body and three raised portions on a second side of said body, said body having a predetermined length and a first of said raised portions extending substantially the entire length of said body, each of said other raised portions being of predetermined different lengths, each extending from a first end of said body and terminating a predetermined distance from a second end of said body;

a stem attached to said first end of said body of said cam and extending a predetermined distance;

a return spring attached to said second end of said body of said cam;

a movable contact assembly having a substantially U-shaped support section which surrounds said rectangular body of said cam, three spring elements extending from each side of said support section, each of said spring elements having an electrical contact on a first end and a cam engaging portion near a second end, said spring elements being connected to said support section at their second end, said spring elements being in alignment with said raised portions on said body of said cam;

six stationary electrical contacts for contacting said electrical contacts of said movable contact assembly;

a housing for containing said cam, said housing having a rectangular chamber in which said body of said cam moves and an opening for said stem, said housing also having a retaining wall about said rectangular chamber for holding said movable contact assembly in position, said housing also having an open bottom opposite said rectangular chamber;

a cover attached to said open bottom of said housing and supporting said six stationary electrical contacts and also providing an attachment post for said return spring; and, wherein, as said stem and said cam are depressed and moved downward into said housing, said first of said raised portions on said cam engages one of said spring elements of said movable contact assembly causing said electrical contact on said spring element to contact a corresponding stationary electrical contact, and also wherein, as said stem and cam are depressed further into said housing, the remaining raised portions engage other spring elements causing said electrical contacts on said spring elements to contact other stationary electrical contacts thereby resulting in a sequential connection of the electrical contacts as said stem and said cam are depressed into said housing.

11. The apparatus described in claim 10 wherein each of said spring elements has a flexible blade of predetermined length connected to said first end of said spring element and connected to said cam engaging portion, said cam engaging portion having substantially a right angle bend with a corner of said bend engaging said raised portion of said body of said cam, said right angle bend flexibly connected to said second end of said spring element.

12. The apparatus described in claim 10 wherein a second, third, fourth, fifth and sixth of said raised portions extend respectively approximately 1/6, 2/6, 3/6, 4/6 and 5/6 of said predetermined length of said body of said cam from said first end of said body.

13. The apparatus described in claim 12 wherein said first, third and fifth raised portions are located on said first side of said body of said cam and said second, fourth and sixth raised portions are located on said second side of said body.

* * * * *